US005708328A

United States Patent [19]

Mathews et al.

[11] Patent Number: 5,708,328

[45] Date of Patent: Jan. 13, 1998

[54] UNIVERSAL BURN METAL HALIDE LAMP

[75] Inventors: Paul G. Mathews, Chesterland; Brian L. Gordon, Richmond Heights; David E. Korow, Stow; Martin N. Hassink, Macedonia, all of Ohio

[73] Assignee: General Electric Company, Schenectady, N.Y.

[21] Appl. No.: 892,857

[22] Filed: Jun. 3, 1992

[51] Int. Cl.[6] ..... H01J 17/16

[52] U.S. Cl. ..... 313/573; 313/620; 313/634; 313/635

[58] Field of Search ..... 313/573, 576, 313/25, 620, 623, 634, 635, 639, 640, 641, 642

[56] References Cited

U.S. PATENT DOCUMENTS

| | | | |
|---|---|---|---|
| 3,654,506 | 4/1972 | Kuhl et al. | 313/641 |
| 3,858,078 | 12/1974 | Koury | 313/220 |
| 4,161,672 | 7/1979 | Cap et al. | 313/220 |
| 4,171,498 | 10/1979 | Fromm et al. | 313/641 |
| 4,389,201 | 6/1983 | Hansler et al. | 445/26 |
| 4,581,557 | 4/1986 | Johnson | 313/639 |
| 4,798,995 | 1/1989 | Gilliard et al. . | |
| 4,810,932 | 3/1989 | Ahlgren et al. | 313/579 |
| 4,929,863 | 5/1990 | Verbeek et al. | 313/620 |
| 4,987,344 | 1/1991 | Zaslavsky et al. | 313/59 |
| 5,144,201 | 9/1992 | Graham et al. | 313/623 |

OTHER PUBLICATIONS

Lakes & Davenport, "Low Wattage Metal Halide Lamps", J.IES, pp. 66–73, Jan. 1982.

*Primary Examiner*—Sandra L. O'Shea
*Assistant Examiner*—Vip Patel
*Attorney, Agent, or Firm*—George E. Hawranko

[57] ABSTRACT

A metal halide arc discharge lamp rated for not more than 150 watts and 100 volts and which can be operated in either a horizontal or vertical position without a significant change in color temperature or lumen output has an ellipsoidal arc chamber mounted within a nitrogen-containing outer envelope. The arc chamber contains a pair of electrodes, mercury and sodium and scandium iodides and is coated at each end with a heat reflective coating. The chamber aspect ratio, electrode insertion length, metal halide density, coating length and wall loading are defined within narrow ranges.

15 Claims, 2 Drawing Sheets

UNIVERSAL BURN METAL HALIDE LAMP

BACKGROUND OF THE INVENTION

Field of the Invention

This invention relates to a universal burn metal halide lamp. More particularly, this invention relates to a metal halide arc discharge lamp which can be operated in either a vertical or horizontal position without a significant change in color or lumen output which comprises an ellipsoidal shaped arc chamber of less than 1 $cm^3$ volume having a specific aspect ratio, electrode insertion length, metal halide density, wall loading, and a heat reflecting coating on both ends whose length is determined by the length of the chamber.

BACKGROUND OF THE DISCLOSURE

Metal halide arc discharge lamps are invariably made to operate either vertically or horizontally, with some horizontal arc discharge lamps having an arched or bowed arc discharge tube as is well known to those skilled in the art. Operating a metal halide lamp in a position other than that for which it is designed invariably results in substantial color shift and loss in lumen output. Internal convection currents associated with an arc operated in a horizontal position result in a bowing or raising of the arc towards the upper portion of the arc tube. Utilizing an arched or bowed arc discharge tube for metal halide lamps operating in a horizontal position has been found to result in an increase in the efficiency of the lamp because the arc does not extend as close to the upper wall surface of the arc chamber as it would if the arc tube were not arched. A commercially available metal halide lamp which permits its use in either a vertical or horizontal position employs a complex design which is expensive to manufacture and includes a cylindrical arc tube or chamber having rounded ends which is surrounded by a quartz shroud for heat balance in the arc chamber. The quartz shroud is electrically insulated to minimize sodium loss from the arc chamber which requires a complex, costly mounting design. The shrouded arc chamber is enclosed in an evacuated outer envelope. Having a vacuum within the outer envelope of this lamp requires the use of a starting aid comprising a non-linear capacitor and UV-emitting glow capsule or capacitively coupled glow bottle in the outer envelope. A lamp of this type is generally disclosed in U.S. Pat. No. 4,987,344. Consequently, there is still a need for a simple, relatively inexpensive metal halide arc discharge lamp which can be universally used in that it can be burned in any position ranging from horizontal to vertical, without incurring too much of a change in lumen output or color.

SUMMARY OF THE INVENTION

The present invention relates to a universal burn metal halide arc discharge lamp rated for a power input of not more than 150 watts, said lamp comprising a light transmissive, ellipsoidal shaped arc discharge chamber of less than 1 $cm^3$ volume having an aspect ratio ranging between 1.6–2.3, coated at both ends with a heat reflective coating whose length at each end is from 12–16% of the arc chamber length and having a wall loading of 17–23 watts/$cm^2$ during operation of said lamp, said chamber further containing (i) a pair of spaced apart electrodes each extending into said chamber for a distance no greater than 15% and preferably no greater than 13% of said chamber length, (ii) inert starting gas, (iii) a sodium halide and at least one additional metal halide in an amount sufficient to achieve a metal halide density of 1.5–4.0 mg/$cc^2$ and (iv) mercury in an amount sufficient to achieve a voltage of no more than 100 volts. It is essential for proper operation of the lamp that the arc chamber be enclosed within a vitreous outer envelope containing a suitable inert gas, such as nitrogen, in the space between the arc chamber and outer envelope wall. By universal burn is meant a difference between vertical and horizontal lamp operation of no more than (i) 500° K in color temperature and (ii) 10% in lumen output based on the larger value.

DETAILED DESCRIPTION

Figure 1:
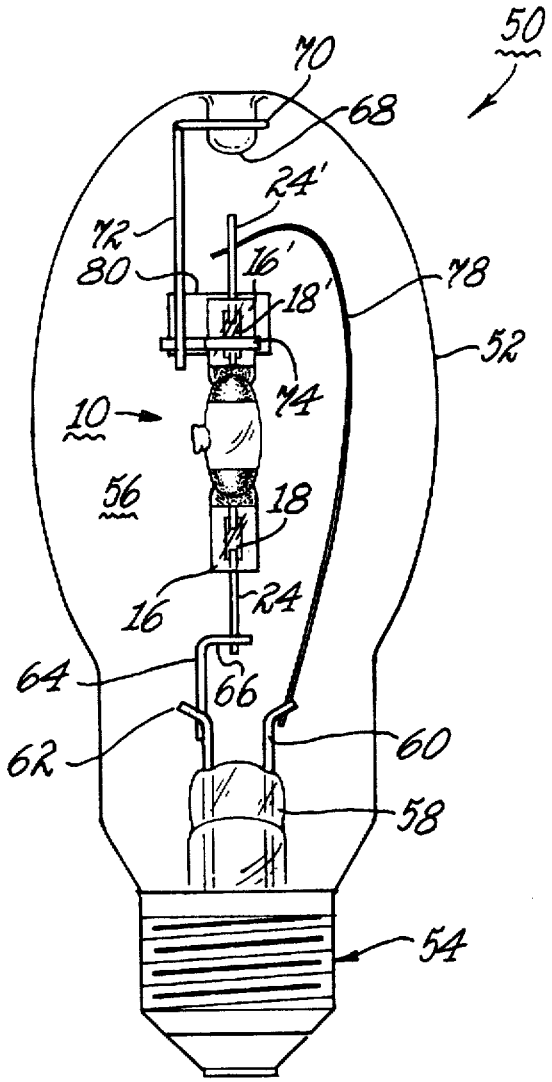
FIG. 1 schematically illustrates a completed lamp assembly according to an embodiment of the invention.

Turning to FIG. 1, lamp assembly 50 is schematically illustrated as including an outer envelope 52 made of a suitable light transmissive, vitreous material such as glass with a typical screw base 54 at one end having suitable electrical contacts for making electrical connection to an appropriate source of electric power. The space 56 within outer envelope 52 contains a suitable inert gas, such as nitrogen or mixture of nitrogen and a noble gas (i.e., argon) at a pressure of up to about 400 torr. Terminal 62 passes through hermetic stem seal 58 and is welded to one end of support rod 64. The other end of terminal 62 is connected by means not shown to base 54. Leg 66 of support 64 is welded to inlead 24. Inlead 24 is in turn welded to molybdenum sealing foil 18 hermetically sealed in pinch seal portion 16 of arc tube or lamp 10. An anchoring dimple 68 is provided at one end of envelope 52. Ring 70 is disposed around dimple 68 and forms one end of support rod 72. Support rod 72 is welded to strap 74 which is wrapped around pinch seal 16' to provide support for that end of lamp 10 within envelope 52. One end of lead wire 78 is welded to terminal 60 and the other end is welded to inlead 24' which passes into press seal 16' of arc tube 10 where it is welded to molybdenum foil 18' hermetically sealed in pinch seal 16'. A zirconium-aluminum alloy getter 80 is welded to support rod 72 to absorb hydrogen and water vapor from the interior space 56 of outer envelope 52. Outer envelope 52 is glass and, if desired, may contain a coating such as titania, alumina or phosphor disposed on the inner surface.

Figure 2A:
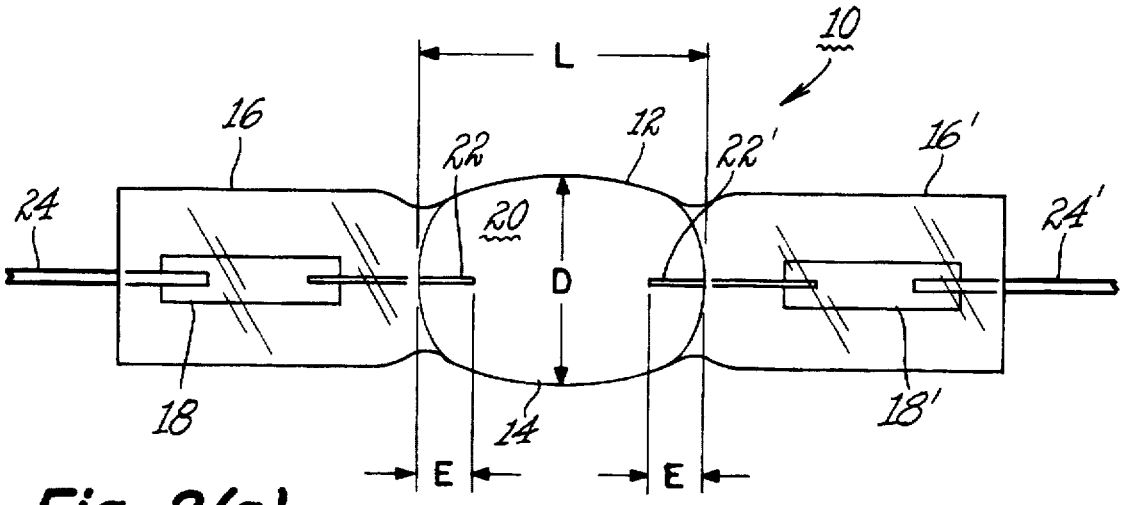
FIGS. 2(*a*) and 2(*b*) schematically illustrate an ellipsoidal arc chamber in accordance with the invention.
Figure 2B:
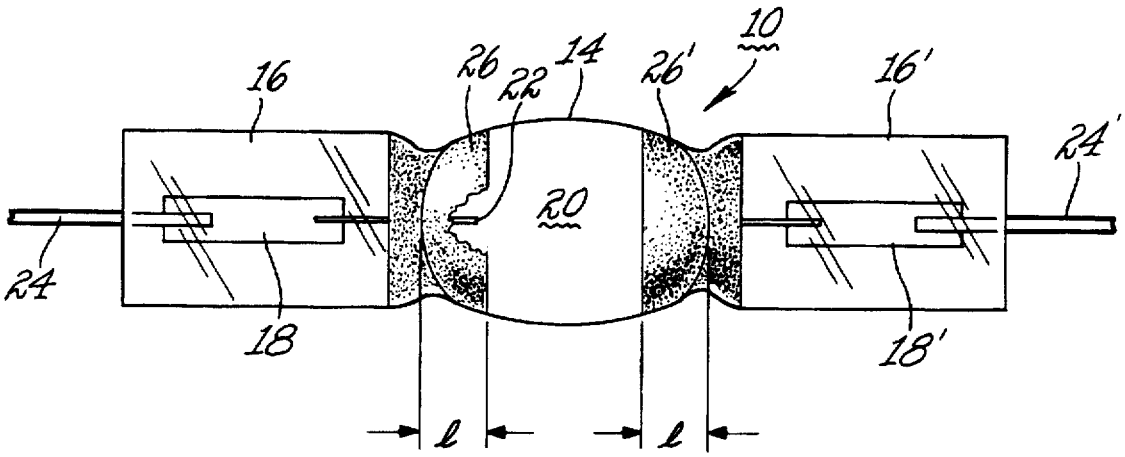

The lamp or arc tube 10 is shown in greater detail in FIG. 2 and includes an envelope 12 of light transmissive vitreous material, such as fused quartz, comprising ellipsoidal arc chamber 14 containing cavity 20 within and terminating at opposite ends in hermetic pinch seal end portions 16 and 16'. End portions 16 and 16' are pinch sealed over molybdenum foils 18 and 18' in order to achieve a hermetic seal. A pair of spaced apart electrodes 22 and 22' are disposed within cavity 20 of arc chamber 14 and are welded to respective molybdenum foils 18 and 18'. Inleads 24 and 24' are welded at one end to foil seals 18 and 18' and extend beyond pinch seal end portions 16 and 16'. The electrodes 22 and 22' each extend into the arc chamber for a distance E which is no greater than 15% and preferably no greater than 13% of the actual arc chamber length L.

FIG. 2(*b*) illustrates lamp 10 containing a heat reflective coating 26 and 26' disposed at each end of ellipsoidal arc chamber 14. The presence of coatings 26 and 26' at opposite ends of arc chamber 14 is an essential feature of the invention and the length L that the coating extends from each end of the ellipsoidal arc chamber will be from 16–20% of the actual length L of the chamber and is greater than the electrode insertion length E into the arc chamber which, in turn, is no greater than 15% of the actual length L of the arc chamber.

All of the parameters listed under SUMMARY above are essential for the practice of the invention and it is the combination of these features which yield a universal burn metal halide lamp without the need for a special "floating" shroud, UV-emitting glow capsule, non-linear capacitor, etc. Thus, the ellipsoidal arc chamber shape, its volume and aspect ratio, the wall loading, the amount of mercury which determines the operating voltage, the presence of a heat reflecting coating and its length on both ends of the arc chamber, the electrode insertion length, the metal halide density and the presence of a suitable inert gas in the outer jacket are all essential for the lamp of the present invention to be able to operate vertically, horizontally or any point in between without incurring a change in color temperature of more than 500° K and a change in lumen output of more than 10% of the greater value. It has been determined experimentally that if any of these parameters are outside the given ranges, then substantially greater differences in color temperature and lumen output will result from differences in the operating position of the lamp or arc tube between vertical and horizontal. Thus, the present invention relates to a unique and unexpected design space wherein a metal halide lamp made according to the parameters defining that design space will be able to operate well in both a vertical and a horizontal position and nearly equally well in both positions. In some respects some of these parameters fall within ranges disclosed in U.S. Pat. No. 4,161,672. However, the lamp disclosed in the '672 patent was designed only for vertical operation (c.f., page 72 in Lake and Davenport, "Low Wattage Metal Halide Lamps", J.IES, p. 66–73, January, 1982).

The arc chamber must be ellipsoidal in shape and must have an aspect ratio broadly ranging between 1.6–2.3 and preferably between 1.8–2.1. Thus the arc chamber will not be either cylindrical or spherical in shape. By aspect ratio is meant the ratio of the theoretical length of the ellipsoidal arc chamber to its maximum external diameter. In fabricating the arc chamber, fused quartz lamp tubing of the appropriate size is blow molded into an ellipsoidal shape as those skilled in the art know and as is disclosed, for example, in U.S. Pat. Nos. 4,389,201 and 4,810,932 the disclosures of which are incorporated herein by reference. The length of the ellipsoidal arc chamber before the end sealing operation is the theoretical length. In the case of shrink seals, the difference between the theoretical and actual arc chamber length may be insignificant. However, the difference between the theoretical arc chamber length and the actual length can be significant if the ends of the arc tube are pinch sealed as illustrated in the figures herein. By way of example, an arc chamber as illustrated in the figures having an actual length of 17 mm and maximum width of 9 mm was made by pinch sealing the ends of an elliptical arc chamber having a molded or theoretical length of 19 mm. Thus, the pinch seal areas or portions of the arc chamber deviate from true ellipsoidal surfaces. As used herein, the term ellipsoidal includes ellipsoidal arc chambers having pinch seals at the end as well as those having shrink seals at the end. The volume of the arc chamber will be less than 1 $cm^3$, preferably less than ¾ $cm^3$ and still more preferably less than ½ $cm^3$. Although the figures illustrate an arc tube having pinch seals, shrink seals may also be employed, inasmuch as the type of hermetic seal at each end of the arc chamber is not critical. Each end of the arc chamber must be coated with a suitable heat reflective coating (i.e., alumina, zirconia, etc.) and, as set forth above, must extend from each respective end of the arc chamber towards the middle thereof for a distance of from 12–16% of the actual arc chamber length. Each end coating may also, if desired, extend over all or a portion of the hermetic pinch or shrink seal. Another important aspect of the invention is electrode insertion length. As set forth above, each electrode will extend into the arc chamber for a distance not exceeding 13% of the actual arc chamber length.

In addition to a pair of spaced-apart electrodes, the arc chamber must also contain a fill comprising an inert starting gas, mercury, a sodium halide and at least one additional metal halide. The total amount of metal halide present should be sufficient to achieve a metal halide density broadly ranging from 1½–4 $mg/cc^2$ of arc chamber wall surface area and preferably from 2–3⅓ $mg/cc^2$. The mercury will be present in an amount sufficient to insure the desired operating voltage which will not exceed 100 watts. The power input into the arc chamber during lamp operation will be an amount to achieve a wall loading of 17–23 $watts/cm^2$ of arc chamber wall surface. The inert gas in the arc chamber will comprise a noble gas, such as argon, useful as a starting gas. The arc chamber or tube will be mounted within an outer envelope as is illustrated in FIG. 1. The outer envelope is glass and can be clear or it may be coated with a phosphor or other material. The space inside the outer envelope (56 in FIG. 1) will contain an inert gas, such as nitrogen, at a pressure ranging from about 200 to 500 torr. The presence of the gas in the outer envelope space has been found necessary in order to achieve the proper heat balance for successful operation of the lamp in either a vertical or horizontal position. If this outer space is evacuated as is disclosed, for example, in U.S. Pat. No. 4,987,344 the lamp will not operate satisfactorily in both vertical and horizontal positions. Nitrogen has been found to be particularly suitable. The nitrogen may contain other inert gases if desired such as one or more noble gases. Use of a noble gas of itself has been found to be unsuitable due to potential arcing in the outer jacket. Although a shroud surrounding the arc chamber has not been used with the lamp of the present invention, if desired one may employ a shroud for protection against bursting of the arc chamber and also include an optical interference coating on the surface of the shroud for selectively transmitting and reflecting various portions of the light spectrum. However, if a shroud is employed it must be spaced sufficiently away from the arc chamber so that it will not interfere with the arc tube emission and the thermal convection currents within the outer envelope required to achieve the proper heat balance.

The invention will be further described by reference to the examples below.

EXAMPLES

Lamps were made as illustrated in FIG. 1, containing an arc tube or chamber as illustrated in FIG. 2, wherein the outer envelope contained 380 torr of nitrogen and the arc chamber in all cases contained about 12 mg of metal halide consisting essentially of sodium iodide and scandium iodide in a 19:1 mole ratio and also containing 3 wt. % thorium iodide. The end coating was alumina and the electrodes were thoriated tungsten. The arc chamber also contained 100 torr of argon as an inert starting gas and about 4 mg of a mercury amalgam containing 3 mole % cadmium. The volume of the arc chamber was 0.4 $cm^3$. These lamps were designed to achieve a color temperature (CCT) of 3200° K and a lumen output of at least 5200 vertical and 5000 horizontal. The lamps were operated at 85 volts (AC) and 70 watts of input power to the arc chamber. Over fifty different sets of lamps were made wherein the variables were the length of the end coat, the electrode insertion length, the aspect ratio, metal halide density and wall loading, of which the examples shown below are merely illustrative. The getter within the outer envelope space was a zirconium-aluminum alloy.

Example 1

In this example all of the arc chambers had an aspect ratio of 1.85, an elliptical arc tube length of 16.5 mm and the wall loading was 20 W/cm$^2$. Each electrode was inserted 3.2 mm into the arc chamber which gave it an electrode insertion length of 19% of the arc chamber length and the coating on both ends of the arc tube extended for a distance of 2.6 mm towards the center of the chamber which gave it an end coat length of 16% of the arc chamber length. The metal halide density was 2 mg/cc$^2$. After 100 hours of operation the horizontal and vertical lumen outputs were 5327 and 6129, respectively. This lumen output was well within the design criteria of at least 5200 for the vertical and 5000 for the horizontal. However, the lumen shift on going from horizontal to vertical was substantially greater than 10%. The color temperature in horizontal and vertical positions was 3217 and 3480 K, respectively, which was within the design color temperature and within the permissible color shift. However, this set of lamps did not meet the criteria for no more than a 10% shift in both lumen output and color temperature. Accordingly, these lamps did not meet the criteria of the invention.

A similar set of lamps was made with the only difference being that the electrode insertion length for each electrode was 2.0 mm or 12% of the arc chamber length. Horizontal and vertical lumens were 5607 and 5645, respectively, which was well within the design and within the criteria for change in lumen output. Moreover the horizontal and vertical color temperatures were 3154 K and 3341 K, respectively, which was also within the design criteria. Accordingly, these lamps met the requirements of the present invention.

Another set of lamps was made similar to the above two sets with an electrode insertion length at each end of 2.6 mm (16%) and the length of the end coat at each end of the arc chamber being 3.2 mm (19%). The vertical and horizontal lumen output of these lamps was 5085 and 5497, respectively. The vertical and horizontal color temperatures were 3352 K and 3306 K, respectively. Although the color was within design and the criteria for lamps of this invention, the vertical lumen output was too low and, consequently, these lamps did not meet the criteria for lamps of the invention.

Example 2

A set of lamps was made having an arc chamber length of 16.4 mm and an aspect ratio of 1.6. The wall loading was 17 watts/cm$^2$. The metal halide density was 2 mg/cc$^2$. The electrode insertion length was 2.0 mm or 12% of the arc chamber length and the length of each end coat was 2.6 mm or 16% of the arc chamber length. On energizing the vertical and horizontal lumens were 5458 and 4965, respectively, while the color temperatures in horizontal and vertical were 3476 K and 3135 K, respectively. Thus, the color temperature and color temperature shift were satisfactory but the horizontal lumens did not meet the criteria of 5000. This lamp was considered to be borderline according to the criteria of the invention.

A similar set of lamps was made with the only difference being in the electrode insertion length which, in this case, was 3.2 mm or 20% of the arc chamber length. The vertical and horizontal lumen output was 4182 and 5611, respectively, whereas the vertical and horizontal color temperatures were 2803 K and 2987 K, respectively. Accordingly, this lamp failed to meet the criteria of the invention in that the vertical lumens were much too low, there was too great a difference between the vertical and horizontal lumen output and the color temperature in the vertical operating position was too low.

A third set of lamps was made with the difference being that the end coating at each end of the elliptical arc chamber was 2 mm long or 12% of the arc chamber length and the metal halide density was 3 mg/cc$^2$. The electrode insertion length was 2 mm or 12% of the arc chamber length. The vertical and horizontal lumens were 5698 and 5474, respectively, with the vertical and horizontal color temperatures being 3221 K and 3423 K, respectively. These lamps thus met the criteria of the invention.

Example 3

In this example lamps were made wherein the arc chamber had a length of 14.2 mm, an aspect ratio of 1.6, a metal halide density of 2 mg/cc$^2$, an electrode insertion length of 2.6 mm or 18% of the arc chamber length and the end coating at each end of the ellipse was 3.2 mm long or 23% of the arc chamber length. The wall loading was 23 watts/cm$^2$. The vertical and horizontal lumens were 4311 and 4592, respectively, whereas the color temperature in vertical and horizontal operation were 2925 K and 2964 K, respectively. Consequently these lamps did not meet the criteria of lamps according to the invention in that both the vertical and horizontal lumen output was too low.

Example 4

In this example, lamps were made having an ellipsoidal arc chamber length of 16.6 mm with an aspect ratio of 2.1, a metal halide density of 2 mg/cc$^2$, an electrode insertion length of 2.0 mm or 12% of the arc chamber length and the length of the coating at each of the arc chamber was 2.6 mm or 16% of the arc chamber length. The wall loading was 23 watts/cm$^2$. The vertical and horizontal lumen output of this set of lamps was 5418 and 5489, respectively, while the vertical and horizontal color temperatures were 3200 K and 3401 K, respectively. These lamps did meet the criteria of the invention. A similar set of lamps identical except for a metal halide density of 4 mg/cc$^2$ also fell within the scope of the invention in having vertical and horizontal lumens of 5266 and 5187 with vertical and horizontal color temperatures of 3135 and 3271 K Another batch of lamps was made with an aspect ratio of 2.1, but with a wall loading of 17 watts/cm$^2$ a coating length at the end of each end of the arc chamber of 3.2 mm and an electrode insertion length of 2 mm or 11%. The vertical and horizontal lumen output of this lamp was 5299 and 5263 while the vertical and horizontal color temperatures were 3096 and 3325 K which satisfied the criteria of the invention, even though the coating length at each end of the arc chamber was 17%. The metal halide density in this lamp was 3 mg/cc$^2$.

What is claimed is:

1. A vitreous, light transmissive arc chamber for a universal burn metal halide arc discharge lamp rated for a power input of not more than 150 watts and having a wall loading of 17–23 watts/cm$^2$ during operation, said arc chamber having an ellipsoidal shape including a volume no greater than 1 cm$^3$ with an aspect ratio ranging between 1.6–2.3, said chamber being coated at both ends with a heat reflective coating whose length at each end is from 12–16% of said chamber length, said chamber enclosing within a pair of spaced apart electrodes each extending into said chamber a distance no greater than 15% of said chamber length, said chamber further containing (i) inert starting gas, (ii) a metal halide comprising a halide of sodium and at least one additional metal in an amount sufficient to achieve a metal halide density of from 1.5 to 4 mg/cc, and (iii) mercury in an amount sufficient to achieve desired operating voltage of no more than 100 volts, and wherein said arc discharge lamp exhibits a difference in lumen output between vertical and horizontal orientation which is less than 10% in variance to one another.

2. The arc chamber of claim 1 wherein said volume is no greater than ¾ $cm^3$.

3. The arc chamber of claim 2 wherein said aspect ratio is between 1.8–2.1.

4. The arc chamber of claim 3 wherein said metal halide density is from 2–3⅓ mg/cc.

5. The arc chamber of claim 4 wherein said volume is no greater than ½ $cm^3$.

6. The arc chamber of claim 5 containing a scandium halide.

7. The arc chamber of claim 6 wherein said halide comprises iodide.

8. A universal burn metal halide arc discharge lamp rated for power input of no more than 150 watts, comprising a vitreous, light transmissive outer envelope with an inert gas present in the space between said arc chamber and the interior surface of said envelope, said chamber having a wall loading of 17–23 watts/$cm^2$ during operation and having an ellipsoidal shape including a volume no greater than 1 $cm^3$ with an aspect ratio ranging between 1.6–2.3, said chamber being coated at both ends with a heat reflective coating having a coating length of from 12–16% of the arc chamber length, and enclosing within a pair of spaced apart electrodes each extending into said chamber a distance no greater than 15% of said chamber length, said chamber further containing (i) inert starting gas, (ii) metal halide comprising a halide of sodium and at least one additional metal in an amount sufficient to achieve metal halide density of from 1.5 to 4 mg/cc, and (iii) mercury in an amount sufficient to achieve desired operating voltage of no more than 100 volts during operation of said lamp, and wherein said arc discharge lamp exhibits a difference in lumen output between vertical and horizontal orientation which is less than 10% in variance to one another.

9. The lamp of claim 8 wherein said gas present within said space between said arc chamber and outer envelope comprises nitrogen.

10. The lamp of claim 9 wherein said arc chamber volume is no greater than ¾ $cm^3$.

11. The arc chamber of claim 10 wherein said aspect ratio is between 1.8–2.1.

12. The lamp of claim 11 wherein said metal halide density is from 2–3⅓ mg/cc.

13. The lamp of claim 12 wherein said arc chamber volume is no greater than ½ $cm^3$.

14. The lamp of claim 13 wherein said arc chamber also contains a scandium halide.

15. The lamp of claim 14 wherein said halide comprises iodide.

* * * * *